US005975953A

United States Patent [19]

Peterson

[11] Patent Number: 5,975,953

[45] Date of Patent: Nov. 2, 1999

[54] EMI BY-PASS GASKET FOR SHIELDED CONNECTORS

[75] Inventor: Eric C. Peterson, McKinney, Tex.

[73] Assignee: Hewlett-Packard Company, Palo Alto, Calif.

[21] Appl. No.: 08/921,007

[22] Filed: Aug. 29, 1997

[51] Int. Cl.[6] ..... H01R 13/648

[52] U.S. Cl. ..... 439/607; 439/108; 174/35 GC

[58] Field of Search ..... 439/607, 608, 439/609, 610, 939, 108, 101; 174/35 R, 36, 35 C, 35 GC

[56] References Cited

U.S. PATENT DOCUMENTS

| | | | |
|---|---|---|---|
| 4,688,868 | 8/1987 | Noyes | 439/108 |
| 5,070,216 | 12/1991 | Thornton | 174/35 GC |
| 5,204,496 | 4/1993 | Boulay et al. | 174/35 GC |
| 5,266,053 | 11/1993 | Jamet et al. | 439/607 |
| 5,317,105 | 5/1994 | Weber | 174/35 GC |
| 5,404,276 | 4/1995 | Hansson et al. | 361/821 |
| 5,686,695 | 11/1997 | Chan | 174/35 GC |
| 5,838,550 | 11/1998 | Morris et al. | 361/818 |
| 5,856,632 | 1/1999 | Bostrom et al. | 174/35 GC |

*Primary Examiner*—Paula Bradley
*Assistant Examiner*—Ross Gushi
*Attorney, Agent, or Firm*—Edward L. Miller

[57] ABSTRACT

Good shielding in shielded peripheral connectors is maintained by including an EMI by-pass gasket between the cable connector and the card connector. The EMI by-pass gasket is a thin but resilient piece of metal somewhat larger than the outline of the connector to connector interface. It has a orifice therein that allows it to be between the connectors as they mate. Interior folded tabs along the edges of the orifice and parallel to the length of the connectors make compressive contact with the outer surface of the connector rim of the cable connector. A front surface or step around the backshell of the cable connector pushes the gasket toward the I/O card bulkhead plate, compressing a pair of opposing bent legs running the length of the gasket against the system enclosure. This provides a low inductance direct RF connection from the rim of the cable connector to the system enclosure (chassis), and in the process, by-passes (shunts) the ground path through the I/O card itself.

4 Claims, 3 Drawing Sheets

EMI BY-PASS GASKET FOR SHIELDED CONNECTORS

BACKGROUND OF THE INVENTION

The continuing proliferation of electronic equipment of all sorts has prompted governments and their various regulatory agencies to promulgate ever stricter limits on the amount of electromagnetic interference (EMI) that devices may generate. As these stricter rules take effect, and as computer equipment gets faster and faster, even simple cabling solutions that were satisfactory five or ten years ago are not suitable today.

Consider, merely as an example, a shielded SCSI or HIPPI connector on a PCI/ISA I/O card. A number of RF connections must be made to satisfactorily ground the shield in the connector and the shield in the cable. Typically, these include: a connection from the cable shield to the shield of the backshell of the cable connector; cable connector backshell shield to the rim of the cable connector; cable connector rim to card connector rim; card connector rim to card bulkhead plate; and, card bulkhead plate to the system enclosure (chassis). If any one of these connections is a poor RF connection the shielding of the connectors and the cable are compromised, and the equipment may fail to meet the standards it was certified to meet. This is especially true of I/O cables, since they are apt to be applied to and removed from their mating connectors many times during the life of the equipment. It would be desirable if there were a way to ensure good shielding performance despite deterioration in the ground path connections not within the cable connector itself (i.e., in the cable connector to card connector interface and on into those involving the card and chassis).

SUMMARY OF THE INVENTION

A solution to the problem of maintaining good shielding in shielded peripheral connectors is to include an EMI by-pass gasket between the cable connector and the card connector. The EMI by-pass gasket is a thin but resilient piece of metal somewhat larger than the outline of the connector to connector interface. It has a orifice therein that allows it to be between the connectors as they mate. Interior folded tabs along the edges of the orifice and parallel to the length of the connectors make compressive contact with the outer surface of the connector rim of the cable connector. The front surface or step around the backshell of the cable connector pushes the gasket toward the I/O card bulkhead plate, compressing a pair of opposing bent legs running the length of the gasket against the system enclosure. This provides a low inductance direct RF connection from the rim of the cable connector to the system enclosure (chassis), and in the process, by-passes (i.e., is a shunt around) the ground path through the I/O card itself.

DESCRIPTION OF A PREFERRED EMBODIMENT

Figure 1:
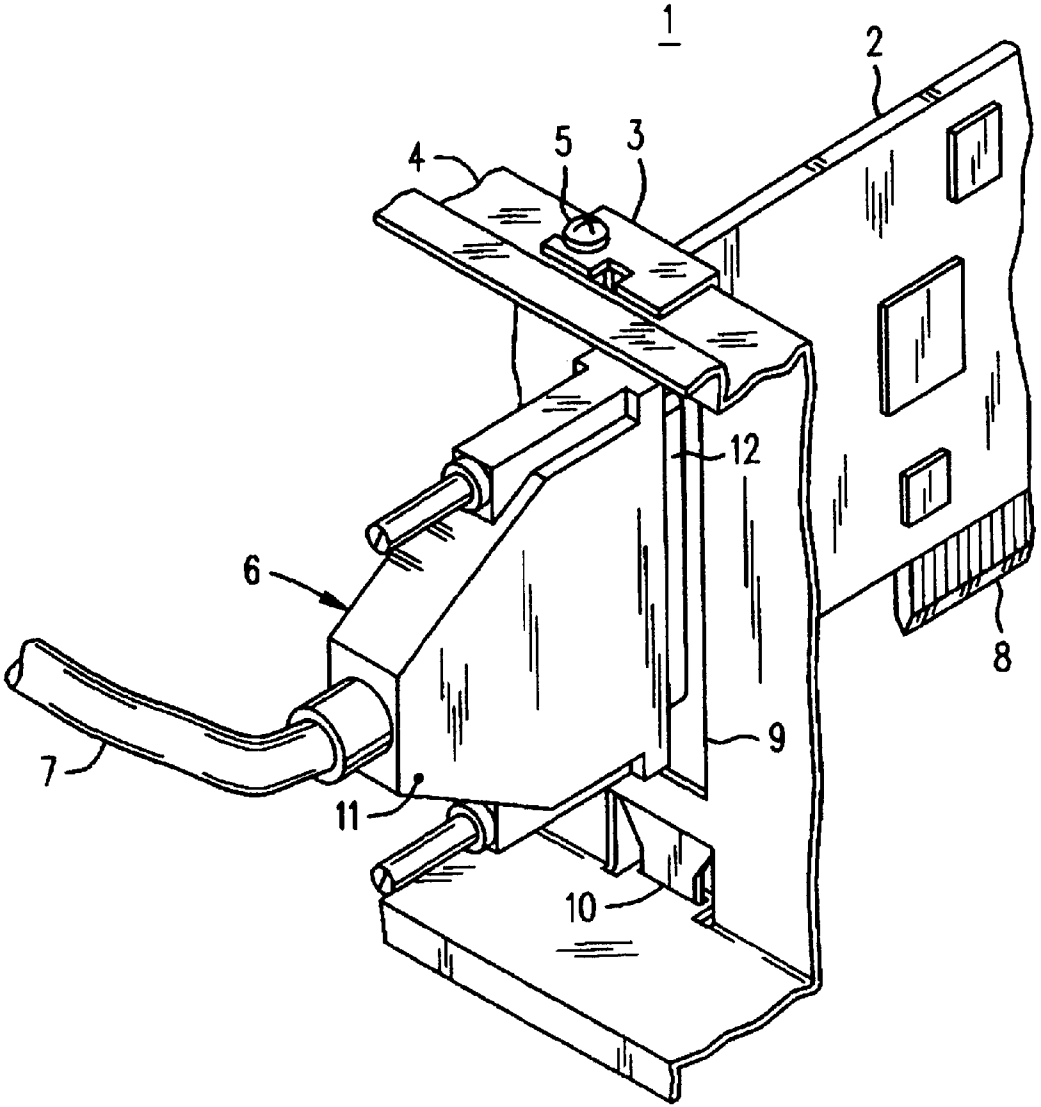
FIG. 1 (PRIOR ART)
FIG. 1 is a simplified perspective view of a prior art manner of connecting a shielded cable to an I/O card of a computer with a shielded connector.

Refer now to FIG. 1, wherein is shown a perspective view of a prior art manner 1 of connecting a shielded cable connector 6 to an I/O card or other circuit assembly 2 in a computer or other device (not shown). The shielded cable connector 6 is connected to a shielded cable 7 on one side, and mates with a shielded card connector (13, shown in FIG. 2) carried by a circuit assembly 2. The shielded cable connector and card connector may be of the SCSI or HIPPI variety. HIPPI is an interface standard described by ANSI X3. 183–1991; see especially the document X3T11/92-REV 8.2 of Mar. 3, 1993. Like SCSI, HIPPI uses a connector that has two long sides that are parallel. Circuit assembly 2 may be a printed circuit board having connector lands 8 that engage a connector carried by a mother board assembly (not shown). The circuit assembly 2 has attached at one end a bracket, or bulkhead plate 3 that, when the circuit assembly is installed in the mother board, covers and contacts slot 9 (and enters slot 10) in a panel 4 that is the chassis of the computer or other equipment. The circuit assembly 2 and its bulkhead plate 3 may be of the PCI/ISA style.

It will be appreciated that the ground path for the shield of the cable connector 6 passes from the shield of cable 7 to a backshell shield (which if the connector has a metal outer enclosure is the outer shell 11, and which otherwise is underneath that outer enclosure, and thus not visible), to the outer rim 12 of the cable connector, to a corresponding outer rim of the card connector (13 in FIG. 2), and thence via the bracket 3 to reach the chassis panel 4.

Figure 2:
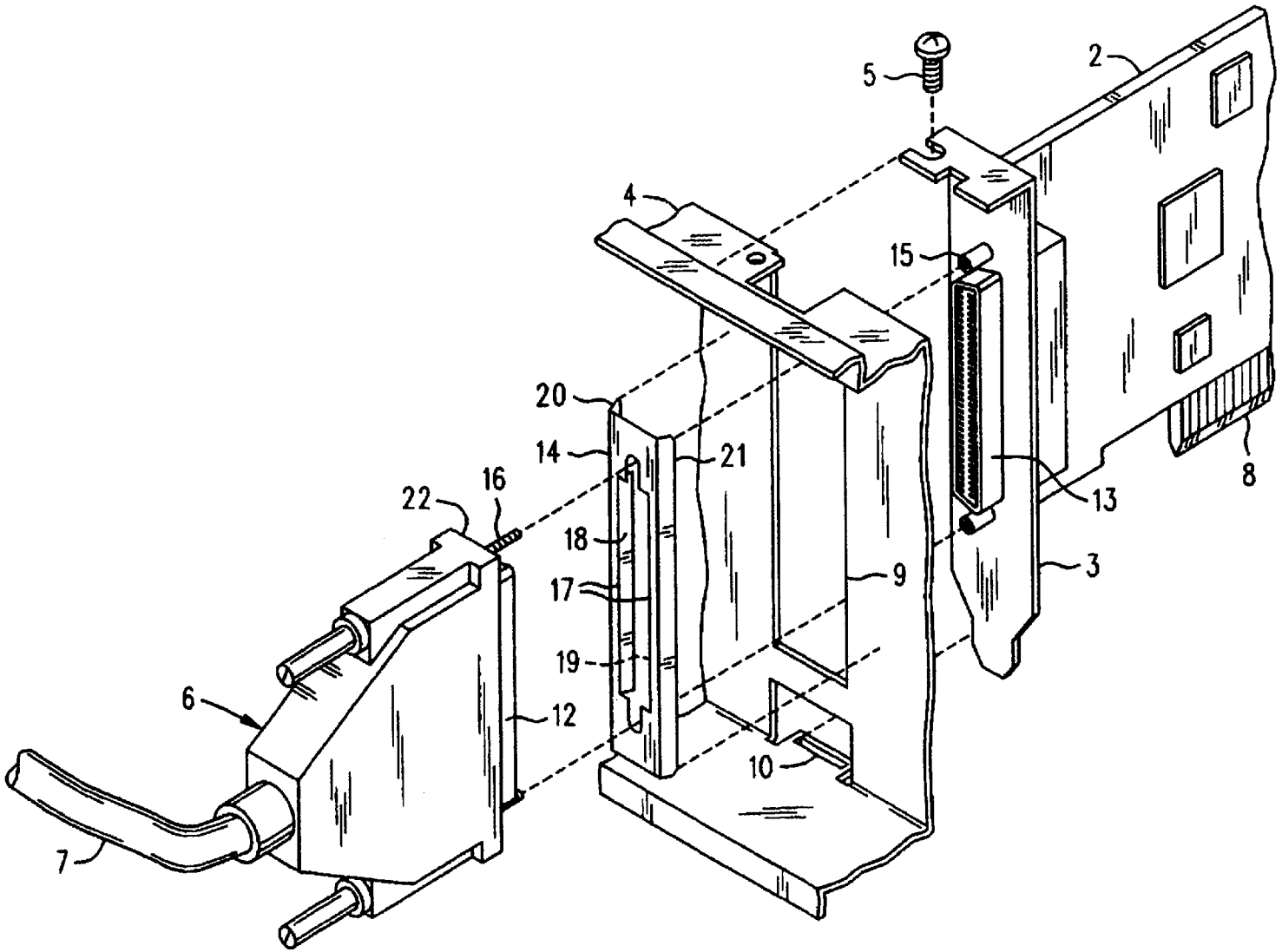
FIG. 2 is an exploded perspective view of an improved ground connection that is produced between a shielded cable connector and a chassis by an EMI by-pass gasket.

The ground path for the cable 7 and cable connector 6 may be shortened and its reliability improved by use of the metallic EMI by-pass gasket 14 shown in FIG. 2. It includes two fairly stiff but resilient metal contacts 18 and 19 that bear against, and reliably electrically connect to, the outer rim 12 of the cable connector 6. These contacts are as wide as the exposed outer rim 12, so as to reduce their inductance. Since they push toward each other, they do not lose electrical contact, even if the cable connector 6 moves while connected. They are also fairly short, and in parallel with each other, which also reduces the resulting inductance. The EMI by-pass gasket 14 has an orifice 17 that allows it to reside between the cable connector 6 and the card connector (26, see FIG. 5) when these connectors are mated. When the circuit assembly 2 is installed the bulkhead plate 3 is aligned with the slot 9 such that it covers, or occludes it, and the EMI by-pass gasket 14 is wide enough that its opposing bent legs 20 and 21 bear against the chassis metal surrounding slot 9 to provide a direct electrical connection between the outer rim 12 of the cable connector 6 and the chassis 4.

Figure 3:
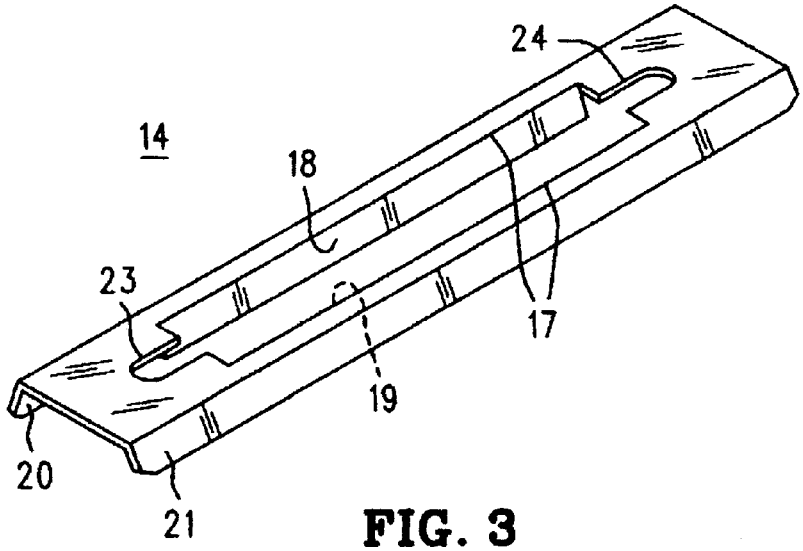
FIG. 3 is a front perspective view of the EMI by-pass gasket of FIG. 2.
Figure 4:
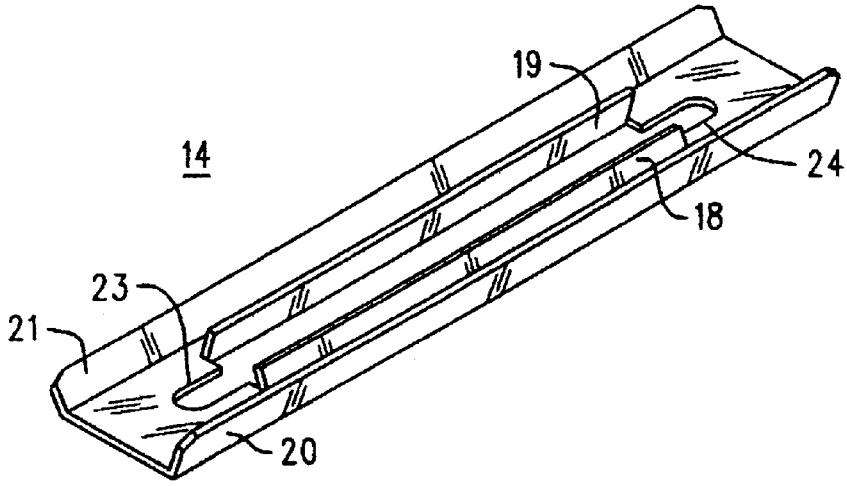
FIG. 4 is a rear perspective view of the EMI by-pass gasket of FIG. 2.

Refer now to FIGS. 3 and 4, wherein are shown front and rear perspective views of the EMI by-pass gasket 14 in isolation. Note that folded surfaces 18, 19, 20 and 21 each form concavities with the surface of the gasket 14. Each concavity faces the chassis when the gasket is in use. Also note regions 23 and 24 of the orifice 17. These allow the two connector parts 25 and 26 to be made captive to each other with screw fasteners (15 and 16 in FIG. 2).

Figure 5:
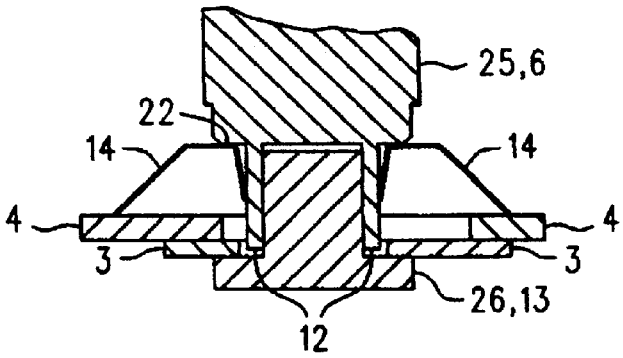
FIG. 5 is a simplified cross sectional view of the unexploded arrangement of FIG. 2.

Refer finally to FIG. 5, which depicts a simplified cross sectional view of the situation when the EMI by-pass gasket 14 is installed between two mated connectors 25 and 26. Observe that a front surface 22 of connector 25 urges the bent legs of gasket 14 against the chassis 4. Meanwhile, the contacts along the perimeter of the orifice of the gasket are in contact with the outer rim of the connector 26.

In a preferred embodiment EMI by-pass gasket 14 is made of beryllium copper 0.010 inches thick that has been tin plated. Other finishes and other materials, such as stainless steel and brass are certainly possible. The preferred method of forming the EMI by-pass gasket is stamping.

An article such as described herein has been manufactured and used in conjunction with shielded SCSI and HIPPI connectors to successfully reduce EMI from a peripheral I/O card for a computer.

I claim:

1. Data communications apparatus comprising:

a chassis having a slot therein;

a circuit assembly;

a bulkhead plate mounted to the circuit assembly and having an opening therein, the bulkhead plate disposed proximate to and covering the slot in the chassis;

a shielded chassis mount connector electrically connected to the circuit assembly, mounted to the opening in the bulkhead plate and extending into the slot in the chassis;

a shielded cable mount connector having a front surface and mated to the chassis mount connector; and a conductive by-pass gasket in compressive contact with the front surface, having opposing bent legs that are compressively urged against portions of the chassis proximate the slot therein and having an orifice therein disposed around the mating between the chassis and cable mount connectors, the orifice having a perimeter from which folded tabs bear against and electrically connect to a shield portion of one of the aforesaid shielded connectors.

2. Apparatus as in claim 1 wherein the shielded chassis mount connector and shielded cable mount connector are SCSI connectors.

3. Apparatus as in claim 1 wherein the shielded chassis mount connector and shielded cable mount connector are HIPPI connectors.

4. An article of manufacture comprising a resilient metal plate having at least two straight sides parallel to each other, having first and second surfaces and having a connector orifice therein whose perimeter includes at least two straight edges that are parallel to each other, there being a folded connector contact depending from each straight edge, each folded connector contact forming a concavity with the second surface, and there being a folded chassis contact depending from each straight side, each folded chassis contact forming a concavity with the second surface.

* * * * *